US007174900B2

(12) United States Patent
Lane et al.

(10) Patent No.: US 7,174,900 B2
(45) Date of Patent: Feb. 13, 2007

(54) HAIR ACCESSORY UTILIZING A DRAWABLE MEMBER AND A SECURING MEMBER

(76) Inventors: Teresa Lane, 4756 Oak St., Apartment 730, Kansas City, MO (US) 64112; Danilo Joseph Dixon, 20 Clinton, #4D, New York, NY (US) 10002

( * ) Notice: Subject to any disclaimer, the term of this patent is extended or adjusted under 35 U.S.C. 154(b) by 296 days.

(21) Appl. No.: 10/760,055

(22) Filed: Jan. 16, 2004

(65) Prior Publication Data

US 2005/0155619 A1 Jul. 21, 2005

(51) Int. Cl.
*A45D 8/04* (2006.01)
*A41G 3/00* (2006.01)

(52) U.S. Cl. ..... 132/273; 132/53

(58) Field of Classification Search ..... 132/200, 132/53, 55, 56, 273, 275, 148
See application file for complete search history.

(56) References Cited

U.S. PATENT DOCUMENTS

| | | | | | |
|---|---|---|---|---|---|
| 541,125 | A | * | 6/1895 | Simonson | 132/53 |
| 1,519,107 | A | | 12/1924 | Breslauer | |
| 1,549,334 | A | | 8/1925 | Ruffio | |
| 1,638,016 | A | | 8/1927 | Oppenheim | |
| 1,713,616 | A | | 5/1929 | Oppenheim | |
| 2,651,310 | A | * | 9/1953 | Selson | 132/274 |
| 3,486,249 | A | | 12/1969 | Mast | |
| 3,520,310 | A | | 7/1970 | Wilmondt | |
| D229,240 | S | | 11/1973 | Fox | |
| D273,341 | S | * | 4/1984 | Rol | D2/601 |
| 4,600,029 | A | * | 7/1986 | Ueberschaar | 132/53 |
| D356,398 | S | | 3/1995 | Hafid | |
| 5,501,239 | A | | 3/1996 | Walker | |
| 5,551,452 | A | * | 9/1996 | Barlow | 132/54 |
| 5,787,904 | A | * | 8/1998 | Michaud | 132/200 |
| 5,873,373 | A | | 2/1999 | Narvick | |
| 5,899,211 | A | * | 5/1999 | Brown | 132/201 |
| 5,937,867 | A | * | 8/1999 | Williams | 132/201 |
| 5,947,129 | A | * | 9/1999 | Bradshaw | 132/54 |
| 6,035,861 | A | | 3/2000 | Copello | |
| 6,135,125 | A | | 10/2000 | Sartena | |
| D433,774 | S | | 11/2000 | Diaz | |
| 6,182,672 | B1 | * | 2/2001 | Abasta-Douglas et al. | 132/275 |
| 6,247,476 | B1 | | 6/2001 | Sartena | |
| 6,257,250 | B1 | | 7/2001 | Sartena | |
| D447,286 | S | | 8/2001 | Diaz | |
| 6,302,115 | B1 | | 10/2001 | Sartena | |
| 6,513,535 | B1 | * | 2/2003 | Lane | 132/201 |
| 6,629,536 | B1 | | 10/2003 | Lane | |
| 6,708,696 | B2 | | 3/2004 | Ferguson | |
| 6,830,054 | B1 | * | 12/2004 | Ross-Kuehn | 132/201 |
| 2004/0103909 | A1 | * | 6/2004 | Silva | 132/148 |

* cited by examiner

*Primary Examiner*—Todd E. Manahan
(74) *Attorney, Agent, or Firm*—Armstrong Teasdale LLP

(57) ABSTRACT

A method for fabricating a hair accessory includes forming a loop with a member having a first end, a middle, and a second end, wherein the loop is formed in the middle of the member. The method further includes attaching a plurality of hair strands including at least one of natural hair and synthetic hair to at least one support member, and spirally wrapping the at least one support member around at least one of the first end, the middle, and the second end of the member.

25 Claims, 4 Drawing Sheets

HAIR ACCESSORY UTILIZING A DRAWABLE MEMBER AND A SECURING MEMBER

BACKGROUND OF THE INVENTION

This invention relates generally to hair accessories and, more particularly, to hair accessories that supplement the natural hair of a user.

Users supplement their natural hair to allow a wider variety of hair styles to be imparted to the user's hair. Additionally, when users are endowed with relatively little hair, the users can supplement their hair to create the impression of a fuller head of hair. At least one known form of a hair piece provides for these objectives by attaching hair to visible hair attachment devices. The hair attachment device is then used to secure the hair piece to a user's head. However, the user may wish to wear a hair accessory to supplement the user's natural hair without a visible attachment device.

BRIEF SUMMARY OF THE INVENTION

In one aspect, a method is provided for fabricating a hair accessory. The method includes forming a loop with a member having a first end, a middle, and a second end, wherein the loop is formed in the middle of the member; attaching a plurality of hair strands including at least one of natural hair and synthetic hair to at least one support member; and wrapping the at least one support member around at least one of the first end, the middle, and the second end of the member.

In another aspect, a hair accessory is provided that includes an elongated member having a first end, a middle, and a second end. A loop is formed with the member, wherein the loop is formed in the middle of the member. The hair accessory also includes a strand retention member comprising a plurality of hair strands attached to a support member, wherein the strand retention member is spirally wrapped around at least one of a first end of the elongated member, a middle of the elongated member, and a second end of the elongated member.

DETAILED DESCRIPTION OF THE INVENTION

Figure 1:
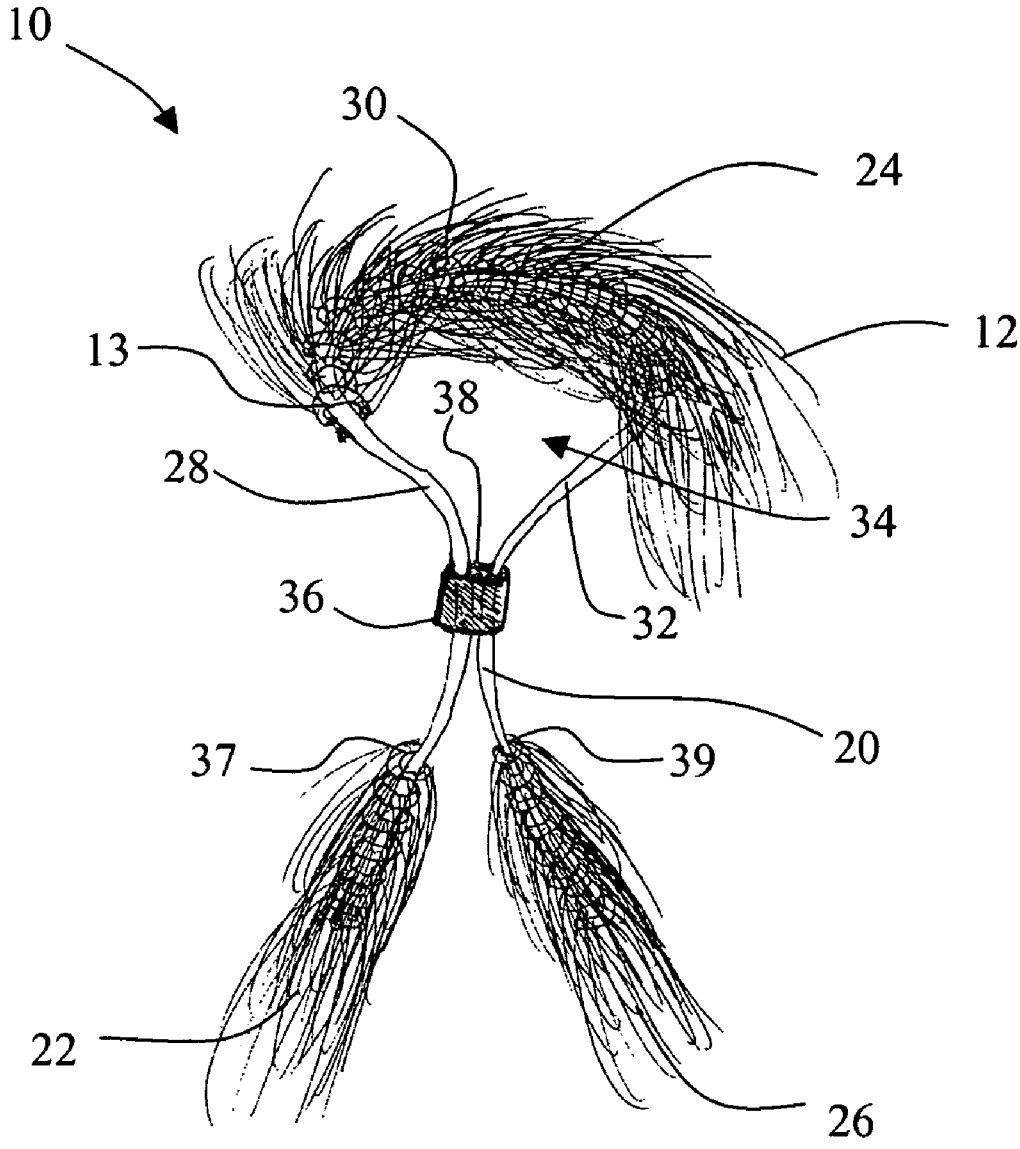
FIG. 1 is a plan view of a hair accessory in accordance with one embodiment of the invention.

FIG. 1 is a plan view of one embodiment of a hair accessory 10 including a plurality of hair strands 12 extending from a base, or strand retention member, 13. Hair strands 12 are, in one embodiment, sewn onto base 13 and held in place with stitching as described in further detail below. In an exemplary embodiment, hair strands 12 are synthetic hair fabricated from a polymer fiber such as modacrylic. In another embodiment, hair strands 12 are synthetic hair fabricated from a polymer fiber other than modacrylic, such as, for example, acrylic. In an alternative embodiment, hair strands 12 are natural hair. In a further alternative embodiment, hair strands 12 include at least one of synthetic hair and natural hair.

Hair accessory 10 further includes a member 20 having a first end 22, a middle 24, and a second end 26. Middle 24 includes a first end section 28, a mid-section 30, and a second end section 32. Member 20 is formed into a loop 34 at middle 24 using a tightening device 36. In one embodiment, tightening device 36 is tube shaped and has an opening 38 extending therethrough. First end section 28 of member 20 and second end section 32 of member 20 each extend through opening 38 of tightening device 36. In an alternative embodiment, tightening device 36 includes a first portion having a first opening (not shown) therethrough and a second portion having a second opening (not shown) therethrough. First end section 28 of member 20 extends through the first opening and second end section 32 of member 20 extends through the second opening.

In both embodiments, tightening device 36 is slidably coupled to first end section 28 and second end section 32. Sliding first end section 28 and second end section 32 through tightening device 36 in a direction away from mid-section 30 of member 20 reduces the size of loop 34 formed in middle 24 of member 20. In one embodiment, tightening device 36 is manufactured from a resilient material such as plastic. Alternatively, tightening device 36 is manufactured from a non-plastic, resilient material. Additionally, tightening device 36 is manufactured from a non-plastic, non-resilient material. Member 20 is manufactured from a stretchable material such as an elastic string or cord. Alternatively, member 20 is manufactured from a non-stretchable material such as string, cord, or ribbon. The material of manufacture of both member 20 and tightening device 36 is such that a sufficient amount of friction is imparted between member 20 and tightening device 36 to maintain member 20 in a substantially fixed position with respect to tightening device 36 while being worn in a user's hair.

Hair accessory 10 includes hair strands 12 attached to mid-section 30, first end 22, and second end 26. In one embodiment, hair strands 12 at ends 22 and 26 are longer than hair strands 12 at mid-section 30. Hair strands 12 are fixedly attached to member 20 such as by sewing, adhesive, pins, and/or clips. Alternatively, any other method of attachment of hair strands 12 to member 20 may be used so long as a portion of the hair strands 12, or base portion 13, is secured to member 20.

Hair strands 12 are attached to mid-section 30 by wrapping base 13 around member 20 in a spiral fashion from first end section 28 to second end section 32. The spiral wrapping allows hair strands 12 to lay at the proper angles and have the appearance of natural hair when worn properly in a user's hair. In one embodiment, base 13 is not fixedly attached to member 20. Alternatively, base 13 is fixedly attached to member 20 and is not permitted to slide along member 20. In a further embodiment, a portion of base 13 is fixed to member 20 thus allowing the non-fixed portions of base 13 to move with respect to member 20 while keeping a portion of base 13 fixed with respect to member 20.

In a similar fashion, hair strands 12 are attached to first end 22 and second end 26 by wrapping base 13 around member 20 in a spiral fashion from a first attachment location 37 to first end 22 and from a second attachment location 39 to second end 26. The spiral wrapping allows hair strands 12 to lay at the proper angles and have the appearance of natural hair when worn properly in a user's hair. In one embodiment, base 13 is fixedly attached to member 20 and is not permitted to slide along member 20. In a further embodiment, a portion of base 13 is fixed to member 20 thus allowing the non-fixed portions of base 13 to move with respect to member 20 while keeping the fixed portion of base 13 fixed with respect to member 20.

To use hair accessory 10, a user gathers a section of the user's natural hair, passes the section of natural hair through loop 34, and closes loop 34 about the section of natural hair, moving tightening device 36 of hair accessory 10 towards mid-section 30. Accordingly, loop 34 is effectively reduced in size to provide a proper fit to the section of natural hair facilitating a retention of hair accessory 10 in the user's natural hair. The user can utilize the addition of hair strands 12 to the user's natural hair to provide various hair styles, some of which may not be attainable, or desirable in appearance, without hair accessory 10.

Figure 2:
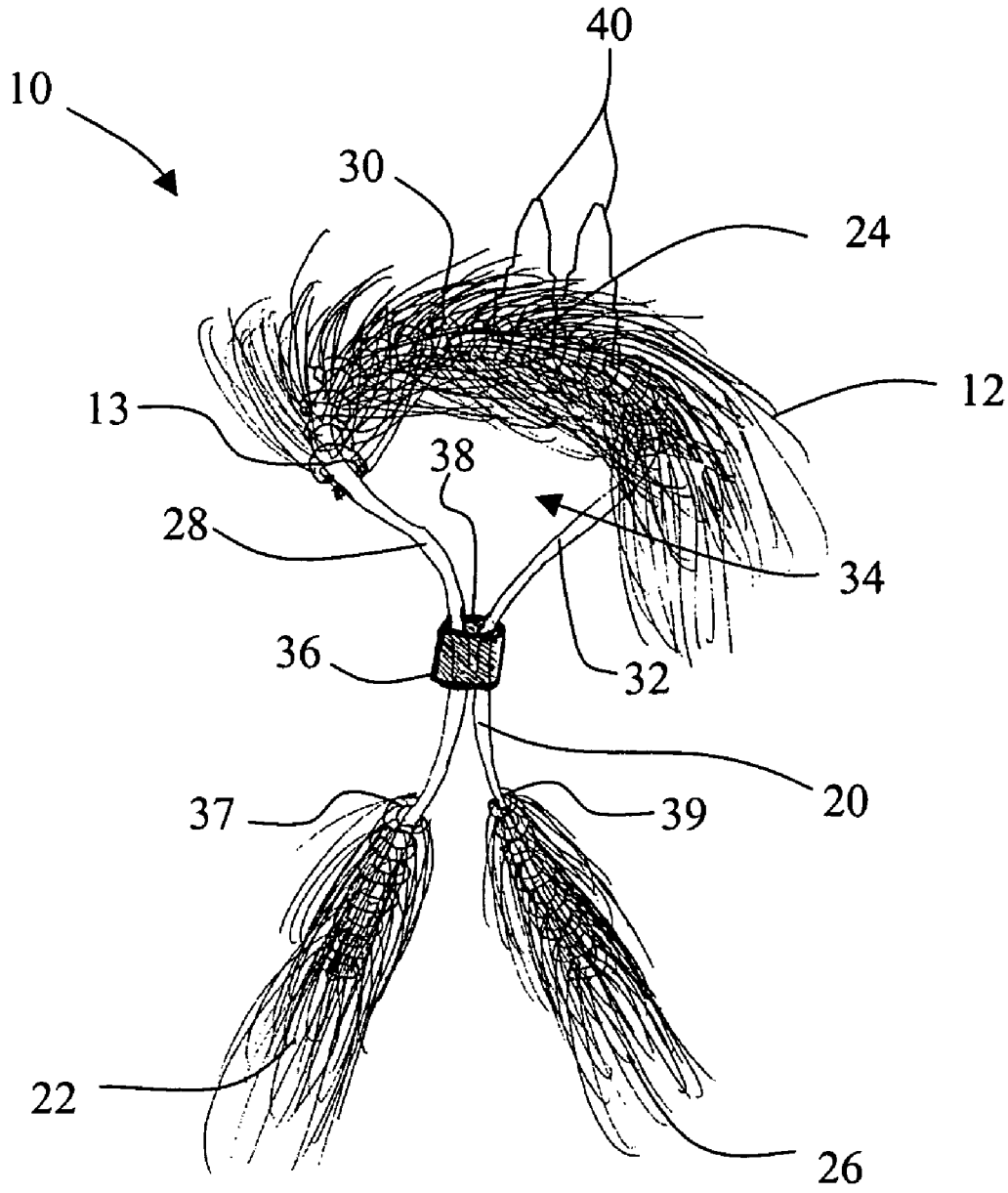
FIG. 2 is a plan view of a hair accessory in accordance with one embodiment of the invention.

FIG. 2 is a plan view of a further embodiment of hair accessory 10 including a hair anchor 40 such as a comb. Comb 40 is slidably attached to the user's hair when the user attaches hair accessory 10, to further secure the attachment of hair accessory 10 to the user's hair, while remaining hidden from view. In the embodiment, comb 40 is attached to base portion 13 in mid-section 30 of member 20. Alternatively, comb 40 may be attached to at least one of first end 22, middle 24, and second end 26 of member 20, and to base portion 13 in any of these locations. Hair anchor 40 is attached to member 20, in one embodiment, by sewing hair anchor 40 to base member 13. Alternatively, hair anchor 40 is attached to base member 13 with adhesive, pins and/or clips. In an alternative embodiment, hair anchor 40 is attached directly to hair strands 12 by sewing, adhesive, pins, clips and/or by tying. In the embodiment shown in FIG. 2 the hair anchor is comb 40. Alternatively, hair anchor 40 may be any device that facilitates securing hair accessory 10 to the user's hair while remaining hidden from view.

Figure 3:
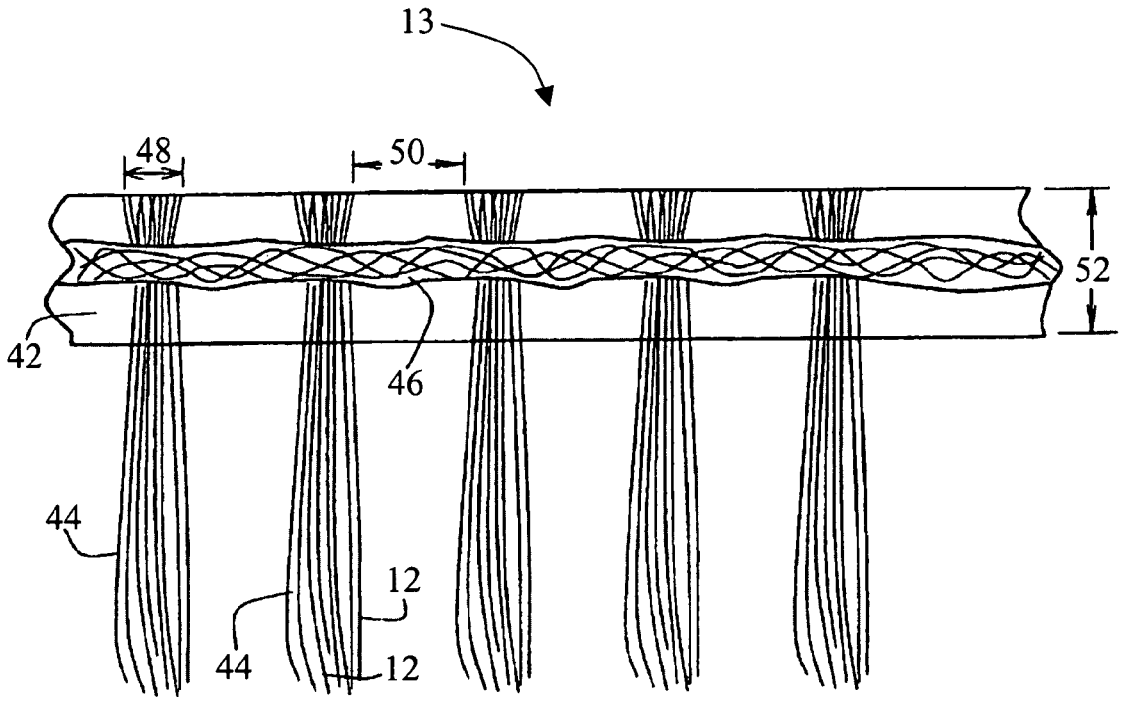
FIG. 3 is a side view of a portion of a strand retention member utilized in fabricating the hair accessory shown in FIGS. 1 and 2.

FIG. 3 is a side view of a portion of base, or strand retention member 13, utilized in hair accessory 10. Strand retention member 13 includes a support member 42 upon which is mounted a plurality of strand bundles 44. Each strand bundle 44 is attached to strand retention member 13 by a plurality of threads 46. Each bundle 44 includes between about fifteen and about forty strands 12. Each bundle 44 has a width 48 of about 1.6 millimeter (mm) and is separated from other bundles 44 by a spacing 50 of about 0.8 mm. Support member 42 includes a width 52 of about 9.5 mm. Strands 12 extend arcuately in a direction normal to the plane of width 52, e.g., into FIG. 3 or out from FIG. 3.

Figure 4:
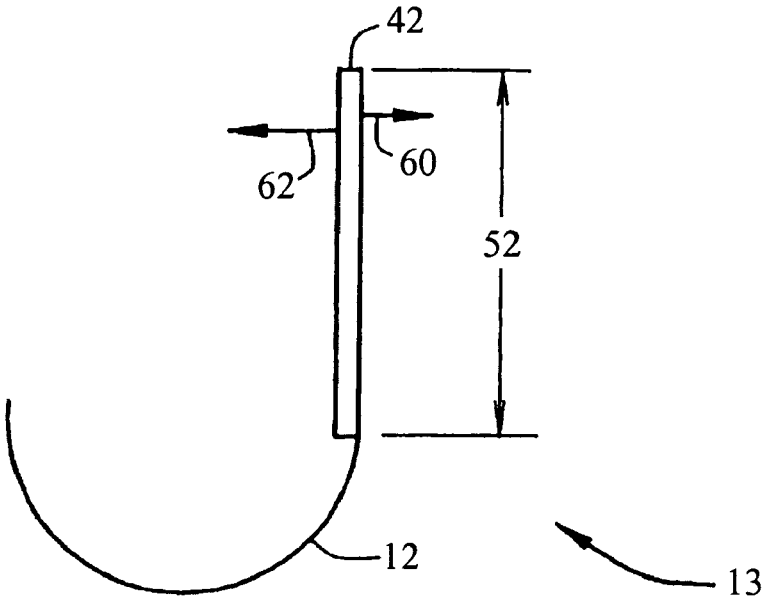
FIG. 4 is an end view of the strand retention member shown in FIG. 3.

FIG. 4 is an end view of strand retention member 13 illustrating a first direction 60 normal to width 52 and a second direction 62 normal to width 52. Strands 12 arcuately extend in second direction 62.

Figure 5:
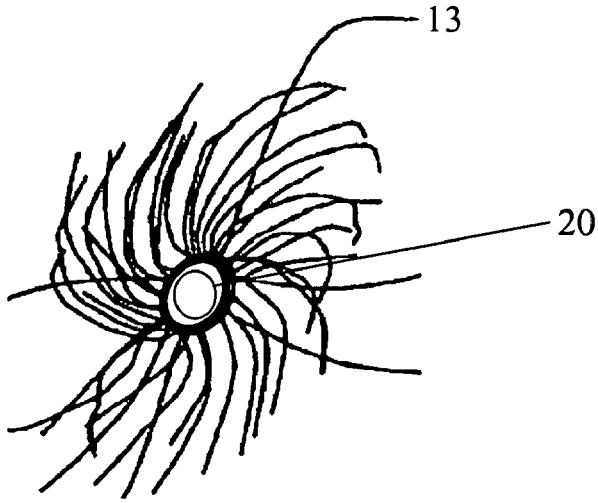
FIG. 5 is a cross-sectional view of the strand retention member shown in FIG. 3 spirally wrapped around the retention member.

FIG. 5 is a cross-sectional view of strand retention member 13 spirally wrapped around at least one of first end 22, middle 24, and second end 26 of member 20. In one embodiment, a plurality of strand retention members 13 are wrapped around first end 22, middle 24, and second end 26 of member 20.

While the invention has been described in terms of various specific embodiments, those skilled in the art will recognize that the invention can be practiced with modification within the spirit and scope of the claims.

What is claimed is:

1. A method for fabricating a hair accessory, said method comprising: forming a loop with a member having a first end, a middle, and a second end, wherein the loop is formed only in the middle of the member; attaching a plurality of hair strands to at least one support member; and spirally wrapping the at least one support member around at least one of the first end, the middle, and the second end of the member.

2. A method according to claim 1 further comprising attaching a hair anchor to at least one item selected from the group consisting of the first end of the member, the middle of the member, and the second end of the member.

3. A method according to claim 1 wherein forming a loop further comprises retaining the loop formed at the middle of the member using a tightening device.

4. A method according to claim 3 wherein the tightening device is slidably coupled to two portions of the member, wherein sliding the portions of the member through the tightening device in a direction away from the middle of the member reduces the size of the loop formed in the middle of the member.

5. A method according to claim 1 wherein attaching a plurality of hair strands further comprises attaching a plurality of bundles of hair strands to the support member.

6. A method according to claim 1 wherein wrapping the at least one support member further comprises spirally wrapping the respective support members around the first end of the member, the middle of the member, and the second end of the member.

7. A method according to claim 1 further comprising attaching a hair anchor to at least one of the hair strands and the support member.

8. The method of claim 1, wherein:

each support member has a length, the method further comprises the step of coupling each support member to the member along only a portion of the respective support member length to allow other portions of the respective support member length to move relative to the member.

9. A hair accessory comprising: an elongated member having a first end, a middle, and a second end; a loop formed with said member, wherein said loop is formed in said middle of said member; and a stand retention member comprising a plurality of hair strands attached to a support member, wherein said strand retention member is spirally wrapped around at least one of a first end of said elongated member, a middle of said elongated member, and a second end of said elongated member.

10. A hair accessory according to claim 9 further comprising a hair anchor attached to at least one of said strand retention member, said first end, said middle, and said second end of said elongated member.

11. A hair accessory according to claim 9 further comprising a tightening device through which extends two portions of said elongated member.

12. A hair accessory according to claim 11 wherein said tightening device is slidably coupled to said elongated member and configured such that sliding a first portion of said elongated member and a second portion of said elongated member through said tightening device in a direction away from said middle of said member reduces a size of said loop formed in said middle of said elongated member.

13. A hair accessory according to claim 9 wherein said plurality of hair strands comprises a plurality of bundles of hair strands.

14. A hair accessory according to claim 9 wherein said strand retention member is spirally wrapped around said first end of said elongated member, said middle of said elongated member, and said second end of said elongated member.

15. A hair accessory according to claim 9 further comprising a hair anchor attached to at least one of said plurality of hair strands and said strand retention member.

16. A hair accessory, comprising:

a tightening device;

an elongate member having a first end, a middle section, and a second end; the first end being distinct from and unattached to the second end; the first and second ends respectively extending through the tightening device to form a loop at the middle section; the tightening device being slidable along the elongate member to adjust a size of the loop; and a plurality of hair strands coupled to an elongate flexible base, the base being spirally wrapped round the elongate member.

17. The hair accessory of claim 16, wherein the base is fixedly coupled to the elongate member, whereby the base is not slidable relative to the elongate member.

18. The hair accessory of claim 16, wherein only a portion of the base is fixedly coupled to the elongate member, whereby other portions of the base are slidable relative to the elongate member.

19. The hair accessory of claim 16, wherein a portion of the base is fixedly coupled to the elongate member and another portion of the base is slidable relative to the elongate member.

20. The hair accessory of claim 19, further comprising a hair anchor operatively coupled to the base adjacent the elongate member.

21. The hair accessory of claim 19, further comprising a hair anchor coupled to the elongate member middle section.

22. A hair accessory, comprising:

a tightening device;

an elongate member having a first end, a middle section, and a second end; the first end being distinct from and unattached to the second end; the first and second ends respectively extending through the tightening device to form a loop at the middle section; the tightening device being slidable along the elongate member to adjust a size of the loop; and a plurality of hair strands coupled to a first elongate flexible base, the first base being spirally wrapped around the elongate member adjacent the first end;

a plurality of hair strands coupled to a second elongate flexible base, the second base being spirally wrapped around the elongate member adjacent the second end; and a plurality of hair strands coupled to a third elongate flexible base, the third base being spirally wrapped around the elongate member middle section.

23. The hair accessory of claim 22, wherein:

at least a portion of the first base is fixedly coupled to the elongate member; and at least a portion of the second base is fixedly coupled to the elongate member.

24. The hair accessory of claim 23, wherein:

at least another portion of the first base is slidable relative to the elongate member; and at least another portion of the second base is slidable relative to the elongate member.

25. The hair accessory of claim 23, further comprising a hair anchor operatively coupled to an element selected from the group consisting of the third base and the elongate member middle section, the hair anchor being completely hidden from view by the hair strands coupled to the third base when worn in the hair of a user.

* * * * *